US005666097A

United States Patent [19]

Leupold

[11] Patent Number: 5,666,097

[45] Date of Patent: Sep. 9, 1997

[54] PERIODIC MAGNETIZER

[75] Inventor: Herbert A. Leupold, Eatontown, N.J.

[73] Assignee: The United States of America as represented by the Secretary of the Army, Washington, D.C.

[21] Appl. No.: 664,366

[22] Filed: Jun. 14, 1996

[51] Int. Cl.[6] ..... H01F 7/02

[52] U.S. Cl. ..... 335/302

[58] Field of Search ..... 335/296–306

[56] References Cited

U.S. PATENT DOCUMENTS

| | | | |
|---|---|---|---|
| 5,382,936 | 1/1995 | Leupold et al. | 335/306 |
| 5,428,335 | 6/1995 | Leupold et al. | 335/306 |

OTHER PUBLICATIONS

H.A. Leupold et al, "Adjustable Multi–Tesla Permanent Magnet Field Sources", IEEE Transactions on Magnetics, vol. MAG–29, No. 6, p. 2902 (1993).

*Primary Examiner*—Aditya Krishnan
*Attorney, Agent, or Firm*—Michael Zelenka; William H. Anderson

[57] ABSTRACT

A magnetizer for use in forming periodic magnetic fields is provided which utilizes two magnet structures which are coaxially aligned with one another. Two stages of magnetic cores are inserted into a gap between the two magnet structures. The stages of magnetic cores each have an upper and lower portion, each portion of which has grooves and ridges which mirror each other. The two different stages of magnetic cores are fabricated such that the respective grooves and ridges are offset and the grooves and ridges of one stage of magnetic core opposes the grooves and ridges, respectively, of the other stage of magnetic core. The two stages of magnetic cores can be active or passive magnetic material. In operation, the two magnetic structures form a uniform transverse magnetic field which passes through a working cavity of the magnetizer. When the two different stages of magnetic cores are inserted into the cavity, the flux from the transverse magnetic field is directed through the ridges of the first stage of magnetic core to magnetize a work piece, which is inserted between a gap in the two different stages of magnetic cores, and then when the first stage is replaced with the second stage of magnetic core, the flux is alternately directed in an opposite direction so that the closely spaced magnetic fields in which the work piece is displaced do not cancel each other.

11 Claims, 3 Drawing Sheets

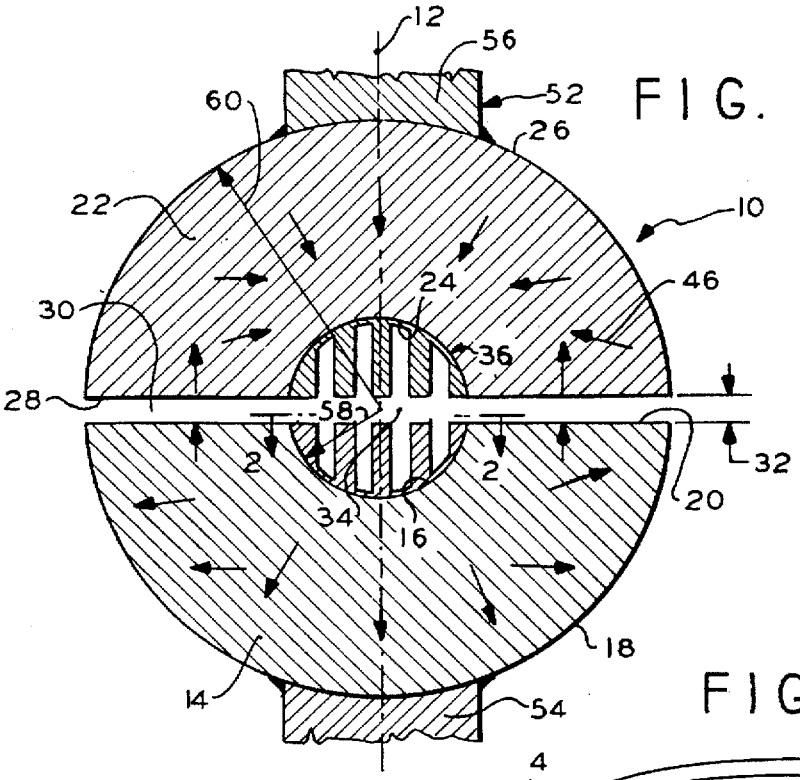
FIG. 1
FIG. 2
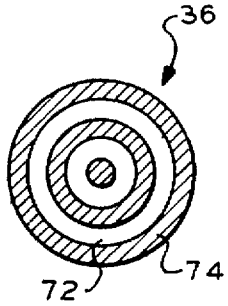
FIG. 3
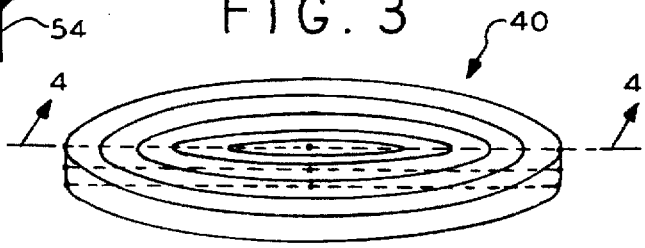
FIG. 4
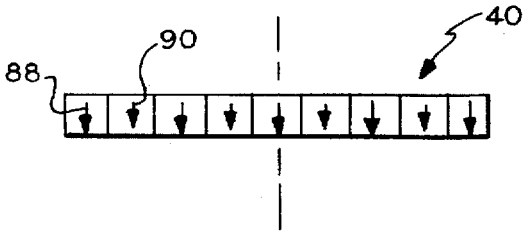
FIG. 5
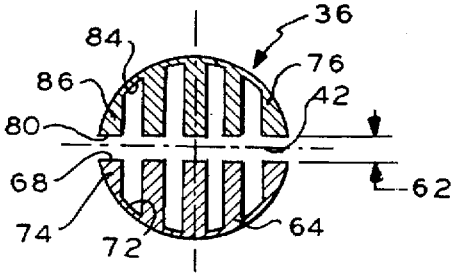
FIG. 6
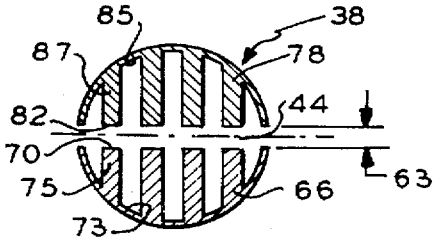

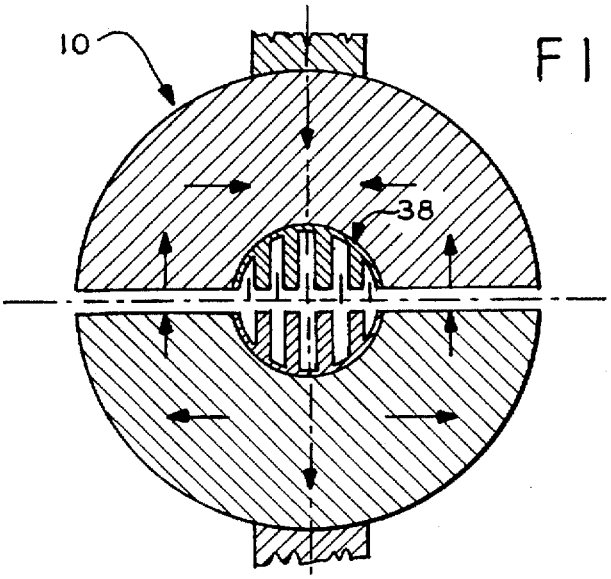
FIG. 7
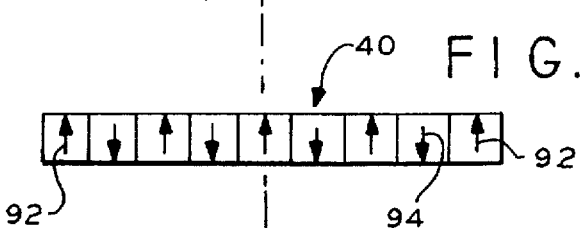
FIG. 8
FIG. 9
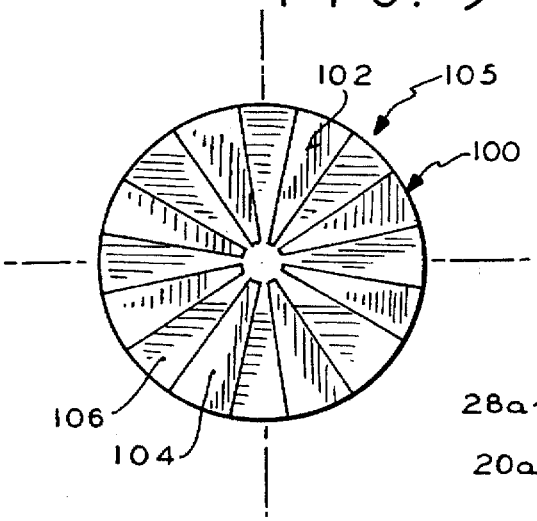
FIG. 10
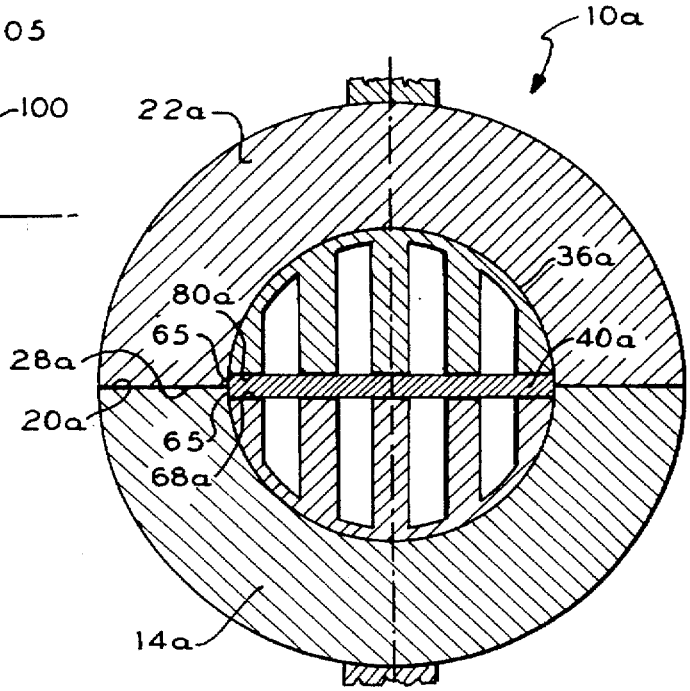

PERIODIC MAGNETIZER

GOVERNMENT INTEREST

The invention described herein may be manufactured, used, imported, sold, and licensed by or for the Government of the United States of America without the payment to me of any royalty thereon.

RELATED APPLICATION

A related copending application by the same inventor is U.S. application Ser. No. 08/637,882, filed 25 Apr. 1996.

FIELD OF THE INVENTION

The invention generally relates to a periodic magnetizer for highly coercive materials, and in particular the invention relates to a permanent magnet periodic magnetizer, which by using a first and second stage magnetic core, each having a lower magnet core portion and an upper magnet core portion with a slit therebetween for receiving a workpiece plate, provides that period magnetic fields of high intensity for magnetizing materials of high coercivity with a periodic field.

BACKGROUND OF THE INVENTION

As is known to those skilled in the art, magnetic structures which are magnetized periodically can be used for many applications, such as for the manufacture of free electron lasers, electric machinery, magnetic bearings, thin film technology, and the like.

In order to magnetize periodic magnet structures, sufficiently strong field amplitudes are required to magnetize the alternate strips of a hard magnetic material. A problem arises, however, because the adjoining, oppositely-poled segments of the magnetizing structure tend to cancel each other's field at close spacing.

Consequently, prior art devices typically only offer alternating magnetic fields in the range of hundreds or thousands of gauss, whereas many applications require alternating fields on the order of teslas.

SUMMARY OF THE INVENTION

Accordingly, it is an object of the present invention to provide a periodic magnetizer that produces sufficiently strong field amplitudes to create oppositely-directed, alternate zones of magnetization in a workpiece of magnetic material.

It is further object of the invention to provide a periodic magnetizer in which the adjoining, oppositely-poled segments of the magnetizing structure will not cancel each other's field at close spacing.

These and other objects of the invention are achieved by using a properly modulated spherical flux source, such as a "magic" sphere comprised of two "magic" hemispheres, which has a central cavity that alternately receives a first and second stage magnetic core to produce a high periodic field within the cavity for periodically magnetizing a disk-shaped workpiece with alternate adjoining, oppositely-directed, ring-shaped or straight fields.

Augmented "magic" spheres are more fully described in U.S. Pat. Nos 5,382,936, issued Jan. 17, 1995, and U.S. Pat. No. 5,428,335, issued Jun. 27, 1995, which are hereby incorporated by reference, and in H. A. Leupold et al, IEEE Transactions on Magnetics, vol. MAG-29 No. 6, pg. 2902, 1993. Augmented "magic" spheres, such as those according to U.S. Pat. No. 5,382,936, include a spherical shell of magnetic material forming a hollow spherical concentric cavity and a spherical field-enhancing insert of either a permanent magnet (i.e., active) or iron magnetic material (i.e., passive) within the cavity magnetized in a predetermined direction. The field-enhancing insert combines with the magnetic flux source to increase the intensity of the working magnetic field.

Similarly, the objects of the invention can be achieved by using properly modulated cylindrical flux sources, such as a "magic" ring or cylinder, which are also described more fully in U.S. Pat. Nos. 5,382,936 and 5,428,335.

Briefly, a periodic magnetizer according to the principles of the invention includes, a magnet portion having a reference axis and having an outer surface and inner surface and an equatorial surface, an upper magnet portion coaxially mounted therewith and having an outer surface and an inner surface and an equatorial surface, the inner surfaces forming a cavity therebetween, the equatorial surfaces forming a gap therebetween, a first stage magnetic core disposed in the cavity, a replacement second stage magnetic core for disposal in the cavity for a two-stage method of magnetization. The first and second stage magnetic cores can either be active magnetic material (e.g., permanent magnet) or passive magnetic material (e.g., iron, suitable iron alloys, and the like). The first stage magnetic core having a lower core portion with a lower bearing surface and an upper core portion with an upper bearing surface, the upper and lower bearing surfaces defining a slit therebetween, the replacement second stage magnetic core having a second lower core portion with a second lower bearing surface, and a second upper core portion having a second upper bearing surface, the second upper and lower bearing surfaces defining a second slit therebetween, the lower bearing surface of the first stage magnetic core having alternate grooves and ridges, the upper bearing surface of the first stage magnetic core having oppositely-facing, identical, alternate grooves and ridges, the second lower bearing surface of the second stage magnetic core having alternate grooves and ridges which are radially offset from the alternate grooves and ridges of the lower bearing surface of the first stage magnetic core, and the second upper bearing surface of the second stage magnetic core having oppositely-facing, identical, alternate grooves and ridges in relationship to the grooves and ridges of the second lower bearing surface.

By using a first stage magnetic core having a lower core portion which has a bearing surface with alternate grooves and ridges and an upper core portion with corresponding grooves and ridges, and by using a second stage magnetic core having a second lower core portion with offset alternate grooves and ridges and having a second upper core portion with offset corresponding grooves and ridges, the closely spaced magnetic fields do not cancel each other, and thus, oppositely directed zones of magnetism in the workpiece can be made.

BRIEF DESCRIPTION OF THE DRAWINGS

The foregoing and other objects, features and advantages will be apparent from the following description of the preferred embodiments of the invention as illustrated in the accompanying drawings.

FIG. 1 is a vertical sectional view of a periodic field magnetizer according to the present invention;

FIG. 2 is a plan view of a lower core portion as taken along the line 2—2 of FIG. 1;

FIG. 3 is a perspective view of a workpiece to be magnetized by the present invention;

FIG. 4 is an enlarged sectional view of the workpiece as taken along the line 4—4 of FIG. 3 after a first stage of magnetization;

FIG. 5 is an enlarged vertical sectional view of a first stage magnetic core (Note: line 4—4 just shows half the core);

FIG. 6 is an enlarged vertical sectional view of a second stage magnetic core;

FIG. 7 is a vertical sectional view of the magnetizer of FIG. 1 with the second stage magnetic core;

FIG. 8 is an enlarged sectional view of the workpiece as taken along line 4—4 of FIG. 3 after a second stage of magnetization;

FIG. 9 is a plan view of a lower core portion used in a second embodiment according to the present invention;

FIG. 10 is a vertical sectional view of another preferred embodiment of the present invention in which the workpiece to be magnetized is completely enclosed.

DESCRIPTION OF THE PREFERRED EMBODIMENTS

Figure 11:
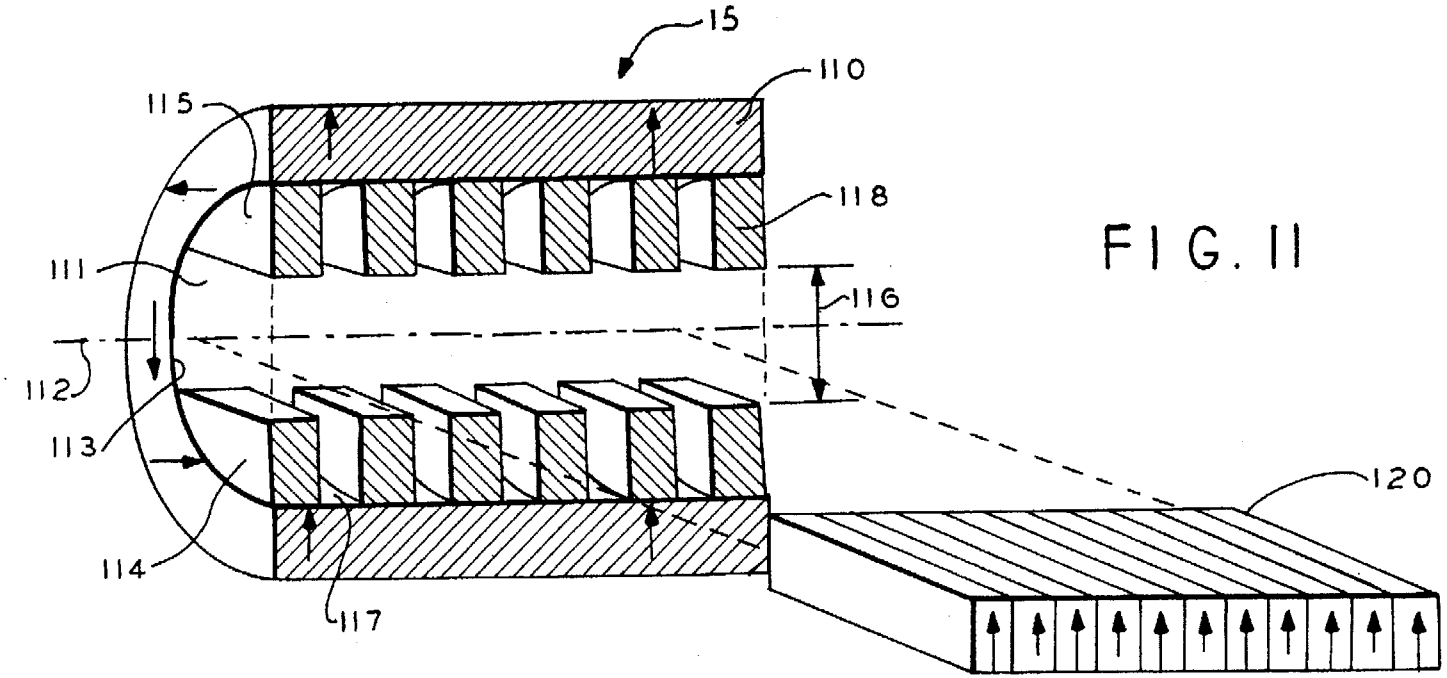
FIG. 11 is a partly sectional, perspective view of another preferred embodiment of the present invention.

As shown in FIG. 1, a magnetizer structure or embodiment, or assembly 10 is provided. Assembly 10 has an axis 12.

Assembly 10 has a lower magnet or hemisphere or support portion 14 which has an inner surface 16 and an outer surface 18 and a lower joint or equatorial surface 20. Assembly 10 also has an upper magnet or hemisphere or support portion 22 which has an inner surface 24 and an outer surface 26 and an upper joint or equatorial surface 28. Upper magnet portion 22 is coaxially aligned . . . and mounted together . . . with lower magnet portion 14 so that equatorial surfaces 20, 28 define an annular or equatorial gap 30 therebetween. Gap 30 has an adjustable gap thickness 32. Inner surfaces 16, 24 form a spherical cavity 34.

As shown in FIGS. 1, 2, and 5, an original magnetic core or first stage core 36 is disposed in the spherical cavity 34 for a first stage of magnetization. As shown in FIGS. 6 and 7, a replacement magnetic core or second stage core 38 is later disposed in spherical cavity 34 for a second stage of magnetization, as explained hereafter.

As shown in FIG. 5, the first stage core 36 includes a lower core portion 64 having a lower bearing surface 68 and an upper core portion 76 having an upper bearing surface 80. The bearing surfaces 68, 80 define an equatorial slit 42 therebetween.

As shown in FIG. 6, the second stage core 38 includes a second lower core portion 66 having a second lower bearing surface 70 and a second upper core portion 78 having a second upper bearing surface 82. The second bearing surfaces 70, 82 define a second equatorial slit 44 therebetween.

Workpiece 40, shown in FIG. 3, is received in equatorial slit 42 of the first stage core 36 during the first stage of magnetization and in equatorial slit 44 of the second stage core 38 during the second stage of magnetization. As Shown in FIGS. 5 and 6, equatorial slits 42, 44 have slit distances or thicknesses 62, 63 respectively which are about equal to the thickness of workpiece 40 (FIG. 3). Equatorial slits 42, 44 are adjustable in thickness so as to accommodate workpieces of varying sizes.

Magnet portions 14, 22 are magnetized in directions shown by lines or arrows 46. Lines 46 are peripherally disposed about axis 12 and are oriented so that their directional angles $\gamma$ with respect to axis 12 vary as $\gamma=2\theta$ where $\theta$ is the polar angle, thereby creating a field in gap 30 that is parallel to axis 12. Thus, the lower and upper magnet portions 14, 22 have a pathway of flux lines which passes axially through the first stage core 36 during the first stage of magnetization and similarly through the second stage core 38 during the second stage of magnetization.

As shown in FIG. 1, assembly 10 also includes a jig 52. Jig 52 has a lower jig portion 54 which is connected to lower magnet portion 14. Assembly 10 has an upper jig portion 56 which is connected to upper magnet portion 22. Assembly 10 also has an actuator (not shown) which is connected to jig portions 54, 56 for varying and adjusting gap thickness 32 and slit thickness 62 and 63 (FIGS. 5 and 6 respectively).

Inner surfaces 16, 24 (FIG. 1) have a common inner radius dimension 58. Outer surfaces 18, 26 have a common outer radius dimension 60. The ratio of the common outer radius dimension 60 to the common inner radius dimension 58 is about three for the preferred embodiment, but is selective depending on the desired application.

As shown in FIG. 5 for first stage core 36, lower bearing surface 68 of the lower core portion 64 includes a plurality of alternately-spaced, concentric, annular teeth or ridges 74 with concentric annular grooves 72 formed therebetween. Likewise, upper bearing surface 80 of upper core portion 76 includes a plurality of alternately-spaced, concentric, annular teeth or ridges 86 with concentric annular grooves 84 formed therebetween. Ridges 86 and grooves 84 of upper core-portion 76 are in an oppositely-facing, matching relationship to ridges 74 and grooves 72 of lower core portion 64.

Similarly, as shown in FIG. 6 for the second stage core 38, second lower bearing surface 70 of the second lower core portion 66 includes a plurality of alternately-spaced, concentric, annular teeth or ridges 75 with concentric annular grooves 73 formed therebetween. Likewise, second upper bearing surface 82 of second upper core portion 78 includes a plurality of alternately-spaced, concentric, annular teeth or ridges 87 with concentric annular grooves 85 formed therebetween. Ridges 87 and grooves 85 of second upper core portion 78 are in an oppositely-facing, matching relationship to ridges 75 and grooves 73 of second lower core portion 66.

The alternate grooves 73, 85 and ridges 75, 87 of second stage core 38 are offset from the alternate grooves 72, 84 and ridges 74, 86 of first stage core 36. To achieve maximum effects of periodic magnetization, grooves 72, 84 of first stage core 36 (FIG. 5) and grooves 73, 85 of second stage core 38 (FIG. 6) should extend to a depth nearly to the boundary of inner surfaces 16, 24 of assembly 10 (FIG. 1).

In a second preferred embodiment, a magnetic core 105 (FIG. 9) is disposed in spherical cavity 34 of assembly 10 (FIG. 1). As shown in FIG. 9, magnetic core 105 includes a lower core portion 100 having a lower bearing surface 102. Lower bearing surface 102 includes a plurality of peripherally-spaced, radial ridges 106 with radial grooves 104 formed therebetween. Likewise, magnetic core 105 includes an upper core portion (not shown) having a plurality of oppositely-facing, matching grooves and ridges (not shown) in a similar relationship as described for first stage core 36 (FIG. 5). A second replacement magnetic core (not shown) includes peripherally-spaced, radial grooves and ridges which are angularly offset from grooves 104 and ridges 106 of magnetic core 105. This arrangement results in a magnetization pattern that is azimuthally periodic.

In another preferred embodiment, bearing surfaces 68*a*, 80*a* of first stage core 36*a* (FIGS. 5 and 10) and bearing surfaces 70*a*, 82*a* of second stage core 38*a* (FIG. 6) each have a recess 65 formed therein for receiving workpiece 40*a* (FIG. 10). Workpiece 40*a* is therefore received in assembly 10*a* so that equatorial surfaces 20*a*, 28*a* of lower and upper magnet portions 14*a*, 22*a* respectively are joined together in a flush relationship to each other as shown in FIG. 10.

Figure 12:
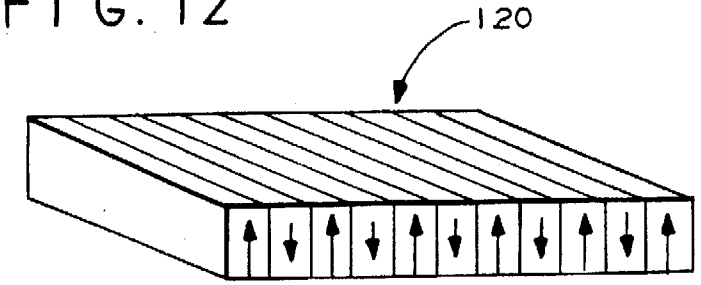
FIG. 12 is a perspective view of a workpiece magnetized by the embodiment shown in FIG. 11.

In another preferred embodiment of the present invention, assembly 15 is provided as shown in FIG. 11. The construction of assembly 15 is similar to the construction of assembly 10 (FIG. 1 ) except for the structure of the first and second stage cores, and also for the cylindrical shapes of the cores and the magnet portions. Briefly, assembly 15 includes a cylindrical magnet portion 110 having an axis 112 and an inner surface 113 defining a cylindrical cavity 111. A magnetic lower core portion 114 and an upper core portion 115 are disposed in the cavity 111. Lower and upper core portions 114, 115 define a slot 116 therebetween for receiving a rectilinear workpiece 120 to be periodically magnetized. Lower and upper core portions 114, 115 each comprise a plurality of alternate ridges or rises 118 with grooves 117 formed therebetween. Ridges 118 and grooves 117 of lower and upper core portions 114, 115 are in an oppositely-facing, matching relationship. In operation, workpiece 120 is inserted along slot 116 for the first stage of magnetization shown in FIG. 11. Workpiece 120 is then inverted and moved one half period along axis 112 for a second stage of magnetization to obtain the magnetization pattern shown in FIG. 12. Assembly 15 therefore provides a rectilinear periodic magnetizer.

In operation, the upper and lower magnet portions 14, 22 respectively of assembly 10 are separated using jig 52 as shown in FIG. 1. First stage core 36 is disposed in spherical cavity 34 to receive workpiece 40 (FIG. 3) for a first stage of magnetization. As shown in FIG. 4, workpiece 40 emerges from the first stage of magnetization with a center zone surrounded by concentric periodic zones or rings of magnetization. Long arrows 88 indicate full magnetization corresponding to the magnetizing effect of the ridges 74, 86 of first stage core 36 (FIG. 5) and short arrows 90 indicate slight magnetization which corresponds to the magnetizing effect from the grooves 72, 84 of first stage core 36.

Upon completion of the first stage of magnetization, upper and lower magnet portions 14, 22 respectively are separated using jig 52 so that first stage core 36 can be removed and replaced with second stage core 38 (FIG. 7). Workpiece 40 (FIG. 3) is inverted and received by second stage core 38. Thus, the fully magnetized zones or rings of workpiece 40 shown by arrows 88 in FIG. 4 are now aligned between grooves 73, 85 of second stage core 38 where the field is at a minimum so as not to result in demagnetization during the second stage of magnetization. The slightly magnetized zones or rings of workpiece 40 shown by arrows 90 in FIG. 4 are therefore aligned between ridges 75, 87 of second stage core 38 where the field is at a maximum. As a result, the slight magnetization of zones or rings in workpiece 40 is fully reversed so that full magnetization in the opposite direction occurs as shown by the pattern of magnetization illustrated in FIG. 8. Long arrows 92, 94 indicate periodic zones of full magnetization in opposite directions.

Given that upper and lower magnet portions 14, 22 respectively are magnetic material having about a 1.2 KG remanence and using an outer to inner radius ratio of about three for assembly 10 (FIGS. 1, 7), the maximum field between oppositely-facing ridges 74 and 86 of first stage core 36 (FIG. 5) and between oppositely-facing ridges 75 and 87 of second stage core 38 (FIG. 6) is about 3.9 KG. The minimum field at the centers of oppositely-facing grooves 72, 84 of first stage core 36 (FIG. 5) and between oppositely-facing grooves 73, 85 of second stage core 38 (FIG. 6) is about 2.6 KG, thus leaving an amplitude variation of about 1.3 KG. The minimum and maximum fields are chosen so that the minimum field is smaller than the coercivity field and the maximum field is greater than the coercivity field. Using this selection of field magnitudes, a workpiece can be magnetized periodically resulting in the patterns depicted in FIGS. 4 and 8 after the first and second stages of magnetization respectively.

The advantages of the present invention are indicated hereafter.

A) Adjoining oppositely poled segments of the magnetizer 10, 10*a*, 15 do not cancel each other's fields at close spacing.

B) Magnetizer 10, 10*a*, 15 can magnetize alternate rings or strips or zones on a workpiece.

While the invention has been described in its preferred embodiment, it is to be understood that the words which have been used are words of description rather than limitation and that changes may be made within the purview of the appended claims without departing from the true scope and spirit of the invention in its broader aspects.

What is claimed is:

1. A magnetizer for use in forming periodic magnetic fields in a workpiece comprising:

a first magnet portion having an axis and having an inner surface and an outer surface and an equatorial surface;

a second magnet portion coaxially mounted together with the first magnet portion and having an inner surface and an outer surface and an equatorial surface;

said inner surfaces forming a cavity;

said equatorial surfaces forming a gap therebetween of selective gap thickness;

a first stage core removably disposed in said cavity for a first stage magnetization sequence, said first stage core having a first lower core portion having a first lower bearing surface having a plurality of alternate grooves and ridges;

said first stage core having a first upper core portion having a first upper bearing surface having a plurality of matching oppositely-facing alternate grooves and ridges;

said first lower bearing surface and said first upper bearing surface forming a slit therebetween with a selective slit thickness;

a second stage core removably disposed in said cavity for a second stage magnetization sequence, said second stage core having a second lower core portion having a second lower bearing surface having a plurality of alternate grooves and ridges which are offset from the grooves and ridges of said first lower core portion of said first stage core;

said second stage core having a second upper core portion having a second bearing surface having a plurality of oppositely-facing alternate grooves and ridges in matching relationship to the grooves and ridges of said second lower core portion;

said second lower bearing surface and said second upper bearing surface forming a second slit therebetween with a selective slit thickness; and said first magnet portion and said second magnet portion, which when combined, have a pathway of flux lines which passes axially through the first stage core or through the replacement second stage core, when disposed in said cavity.

2. The magnetizer of claim 1, further comprising:

a jig apparatus for bringing together and for separating the first and second magnet portions.

3. The magnetizer of claim 1, wherein:

said flux lines are peripherally disposed about said axis;

said flux lines each having a directional angle with respect to said axis that varies as two times a polar angle;

said gap having a magnetization field parallel to said axis;

said magnetization field having a minimum field component between the oppositely-facing grooves of said first and second stage cores;

said magnetization field having a maximum field component between the oppositely-facing ridges of said first and second stage cores;

said minimum field component having a field strength less than a coercivity field; and said maximum field component having a field strength greater than said coercivity field.

4. The magnetizer of claim 1, wherein:

the first and second magnet portions are permanent magnet portions.

5. The magnetizer of claim 1, wherein:

the grooves and ridges of said first and second stage cores are concentrically-spaced annular grooves and ridges.

6. The magnetizer of claim 1, wherein:

the grooves and ridges of said first and second stage cores are peripherally-spaced radial grooves and ridges.

7. The magnetizer of claim 1, wherein:

said first and second magnet portions are hemispheres; and said cavity formed by said inner surfaces of said first and second magnet portions is a spherical cavity.

8. The magnetizer of claim 1, wherein:

the outer surfaces of said first and second magnet portions have a common outer radius dimension;

the inner surfaces of said first and second magnet portions have a common inner radius dimension; and the ratio of the common outer radius dimension to the common inner radius dimension has a selective value of about three.

9. The magnetizer of claim 1, wherein:

said first and second stage cores are permanent magnet cores.

10. The magnetizer of claim 1, wherein:

said first and second stage cores are passive magnetic cores.

11. A magnetizer for use in forming periodic magnetic periods in a workpiece, comprising:

a first magnet portion having an axis and having an inner surface and an outer surface and an equatorial surface;

a second magnet portion coaxially mounted together with said first magnet portion, said second magnet portion having an inner surface and an outer surface and an equatorial surface, the equatorial surface of said second magnet portion joined in a flush relationship to the equatorial surface of said first magnet portion;

said inner surfaces of said first and second magnet portions forming a cavity;

a first stage core removably disposed in said cavity for a first stage of magnetization;

said first stage core having a first lower core portion having a first lower bearing surface having a plurality of alternate grooves and ridges;

said first stage magnetic core having a first upper core portion having a first upper bearing surface having a plurality of alternate grooves and ridges in an oppositely-facing, matched relationship to the grooves and ridges of said first lower core portion;

said first lower and upper bearing surfaces each having a recess formed therein for receiving the workpiece to be periodically magnetized;

a second stage core removably disposed in said cavity for a second stage of magnetization;

said second stage core having a second lower core portion having a second lower bearing surface having a plurality of alternate grooves and ridges radially offset from the grooves and ridges of said first lower core portion of said first stage core;

said second stage core having a second upper core portion having a second upper bearing surface having a plurality of alternate grooves and ridges in an oppositely-facing, matched relationship to the grooves and ridges of said second lower core portion;

said second lower and upper bearing surfaces each having a recess formed therein for receiving the workpiece to be periodically magnetized; and said first magnet portion and said second magnet portion having a pathway of flux lines which passes axially through said first stage core or through said second stage core when disposed in said cavity.

* * * * *